US007891912B2

(12) United States Patent
Taylor et al.

(10) Patent No.: US 7,891,912 B2
(45) Date of Patent: Feb. 22, 2011

(54) TWO STAGE MECHANICALLY STABILIZED EARTH WALL SYSTEM

(75) Inventors: Thomas P. Taylor, Colleyville, TX (US); James Scott Bagwell, Arlington, TX (US)

(73) Assignee: T & B Structural Systems, LLC, Ft. Worth, TX (US)

( * ) Notice: Subject to any disclaimer, the term of this patent is extended or adjusted under 35 U.S.C. 154(b) by 184 days.

(21) Appl. No.: 12/132,750

(22) Filed: Jun. 4, 2008

(65) Prior Publication Data

US 2009/0304456 A1 Dec. 10, 2009

(51) Int. Cl.
*E02D 29/02* (2006.01)

(52) U.S. Cl. ..... 405/286; 405/284

(58) Field of Classification Search ..... 405/272, 405/284, 286, 302.4
See application file for complete search history.

(56) References Cited

U.S. PATENT DOCUMENTS

| | | | | |
|---|---|---|---|---|
| 5,531,547 | A * | 7/1996 | Shimada | 405/262 |
| 2003/0223825 | A1 * | 12/2003 | Timmons et al. | 405/285 |
| 2004/0018061 | A1 * | 1/2004 | Jansson | 405/284 |

* cited by examiner

*Primary Examiner*—David J Bagnell
*Assistant Examiner*—Benjamin Fiorello
(74) *Attorney, Agent, or Firm*—Edmonds & Nolte, PC

(57) ABSTRACT

A system for securing a facing comprising a wire grid that is positionally fixed relative to an earthen formation in a substantially vertical position, a formation anchor that is positionally fixed between the wire grid and the earthen formation, a facing that is laterally offset a distance from the wire grid and having a facing anchor, and a turnbuckle that is rotatably coupled between a first connector and a second connector, wherein the first connector is coupled to the facing anchor and the second connector is coupled to the formation anchor, such that rotation of the turnbuckle relative to the first and second connectors adjusts the distance between the wire grid and the facing.

18 Claims, 5 Drawing Sheets

TWO STAGE MECHANICALLY STABILIZED EARTH WALL SYSTEM

BACKGROUND OF THE INVENTION

Retaining wall structures that use horizontally positioned soil inclusions to reinforce the earth mass in combination with a facing element are referred to as Mechanically Stabilized Earth (MSE) structures. MSE can be used for various applications including retaining walls, bridge abutments, dams, seawalls, and dikes.

MSE has evolved from isolated steel strips used as reinforcements to include metallic grid reinforcements and, most recently, geosynthetic reinforcements. The basic MSE technology is a repetitive process where layers of soil, soil reinforcing and facing are placed one a top the other until a desired height of the earthen structure is achieved. MSE technology has evolved to include a method of construction where an earthen structure with a wire facing element is constructed and, after a predetermined time, a concrete panel is attached to the wire faced earthen structure. This type of MSE construction consists of two stages. First, soil reinforcing elements and backfill material are combined to form an earthen structure held into place by a series of welded wire grids, or other suitable structures. In some applications, the wire grids may be coupled to the soil reinforcing elements thereby holding the earthen formation shape. Second, a concrete wall is constructed a short distance from the earthen structural wall. The concrete wall is then attached in several locations to the earthen formation by a variety of means. In one example, a series of turnbuckle systems are coupled to the back side of the concrete wall and also to the soil reinforcing elements. Outward movement of the wall is prevented via this attachment.

MSE walls derive their strength and stability from the frictional and mechanical interaction between the backfill material and the soil reinforcement elements, resulting in a permanent and predictable load transfer from backfill to reinforcements. The reinforcing elements used can include steel and/or geosynthetics. Originally, long steel strips 50 to 120 mm (2 to 5 in) wide were used as reinforcement. These strips were sometimes ribbed, although not always, to provide added resistance. In some applications, steel grids or meshes have also been used as reinforcement elements. Several types of geosynthetics can be used including geogrids and geotextiles.

Typically the concrete wall may be formed in at least two ways. First, the wall may consist of a uniform, unbroken expanse of concrete or the like which is poured on site. Second, the wall may comprise a plurality of manufactured interlocking precast concrete panels or wall modules which are assembled into interlocking relationship once on site. The several precast concrete panels are stacked end on end on site, thus forming a concrete wall.

In a typical MSE system, the securing means between the concrete wall and the earthen formation is normally attached to the soil reinforcing elements housed in the backfill. This limits the number, length and rotation of the several connectors. In addition, it limits any necessary means of fixing subsequent problems that may arise during the installation of the concrete panels or settlement of any portion of the wall system.

DETAILED DESCRIPTION

Figure 1:
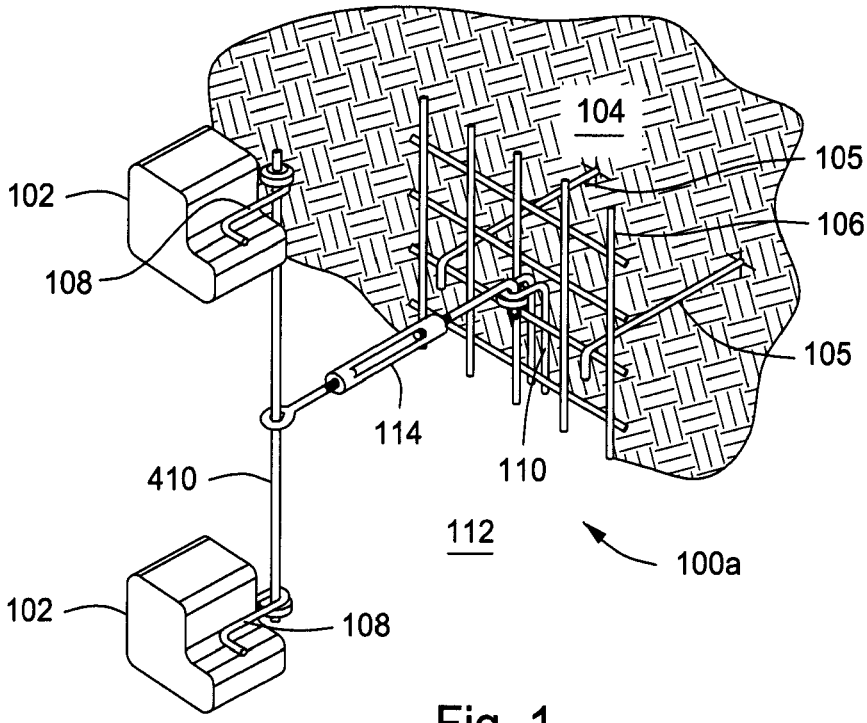
FIG. 1 is a perspective view of a system according to one or more aspects of the present disclosure.
Figure 2:
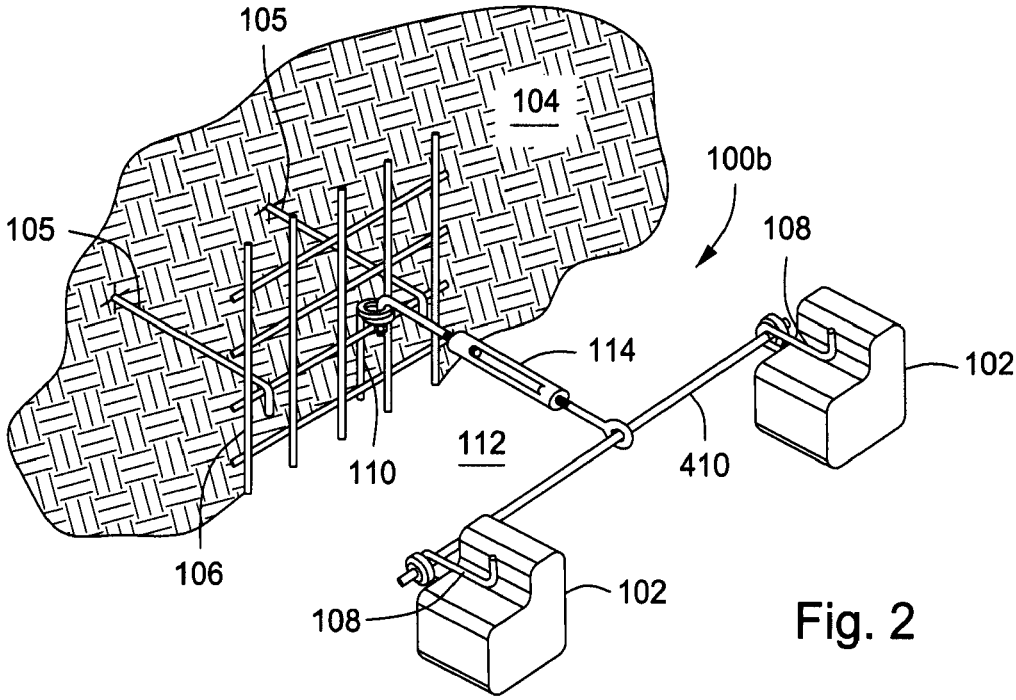
FIG. 2 is a perspective view of a system according to one or more aspects of the present disclosure.

Referring to FIGS. 1 and 2, illustrated are perspective views of systems 100*a-b*, each according to one or more aspects of the present disclosure. Other systems, including systems 100*c-g*, are illustrated in and described with reference to FIGS. 5-9. Any aspect described with reference to any one of systems 100*a-g* as described herein, however, may be applicable and/or readily adaptable to any other of systems 100*a-g*.

In an exemplary embodiment, the system 100 may be used to secure a facing 102 to an earthen formation 104. The facing 102 may comprise an individual precast concrete panel or, alternatively, a plurality of interlocking precast concrete modules or wall members that are assembled into interlocking relationship on the site. Furthermore, the precast concrete panels may be replaced with a uniform, unbroken expanse of concrete or the like which is poured on site.

The earthen formation 104 may encompass a mechanically stabilized earth structure (MSE) including soil reinforcing elements 105 extending into the earthen formation 104 to add tensile capacity thereto. In an exemplary embodiment, the reinforcing elements 105 may comprise tensile resisting elements positioned in the soil in a substantially horizontal alignment at spaced relationships to one another against compacted soil. The earthen formation 104 may further comprise a wire grid 106 consisting of a plurality of vertical wires and a plurality of cross wires configured substantially orthogonal with the vertical wires, all positioned substantially vertical or near vertical against the compacted soil of the earthen formation 104. In an exemplary embodiment, the vertical and horizontal wires of the wire grid 106 may be welded together, but may also be connected via wire ties. Moreover, the wire grid 106 may be secured to the earthen formation 104 via the soil reinforcing elements 105 and configured to prevent the loosening or raveling of the soil between successive layers of soil reinforcing. In alternative embodiments, the wire grids 106 may comprise non-metallic materials, including, but not limited to, plastics or ceramics, and do not necessarily have to be in a substantially horizontal to vertical grid-like pattern. Instead, the wire grids 106 may comprise any pattern designed to form an outer face of any earthen formation 104.

Figure 5:
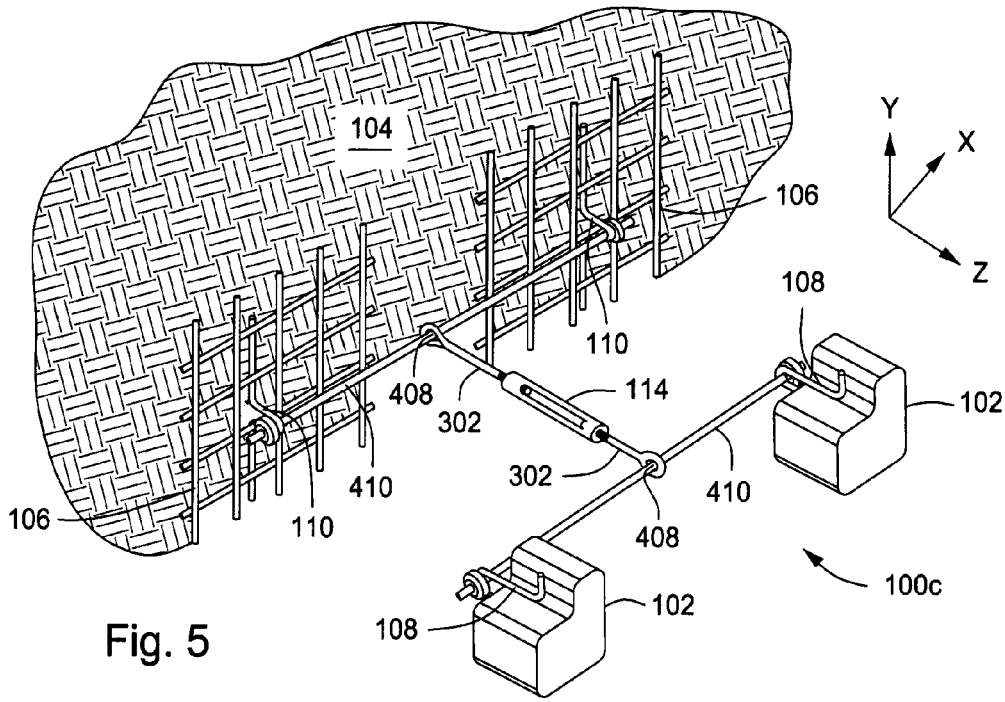
FIG. 5 is a perspective view of a system according to one or more aspects of the present disclosure.

In an exemplary embodiment, the systems 100*a-b* comprise several elements. Cast into the facing 102, or attached thereto, and protruding from the back face, is at least one facing anchor 108 defining an aperture. The facing anchor 108 may be configured, but is not limited to, seat horizontally (FIG. 1) or vertically (FIG. 2). Likewise, at least one formation anchor 110 defining an aperture may be coupled to the wire grid 106 and seated either horizontally (FIG. 1) or vertically (FIG. 5). To accomplish this, the formation anchor 110 may be inserted through the face of the wire grid 106 and positionally fixed between the earthen formation 104 and the grid 106, allowing the pressure of the earthen formation 104 against the wire grid 106 to hold the formation anchor 110 in place. In other words, the formation anchor 110 is not connected to a soil reinforcing element 105. In an alternative embodiment, the formation anchor 110 may be attached to the wire grid 106 by means of wire rebar ties, welds or mechanical fasteners.

As appreciated by those skilled in the art, the formation anchor 110 may comprise an assortment of shapes and sizes and consist of diverse materials. Because it is the wire grid 106 that is secured to the earthen formation 104 and not the formation anchors 110, the anchors 110 themselves may be embedded within the wire grid 106 at any desired location after the earthen formation 104 has been erected. This allows the user to automatically match up any number of formation anchors 110 to a corresponding facing anchor 108 located on the facing 102 wall. In this manner, the number of connection points for the formation anchor 110 on the wire grid 106 is limitless and not dependent on the number of soil reinforcing elements 105 that extend into the enclosed backfill.

A central cavity 112, whose dimensions may vary, separates the facing 102 from the earthen formation 104. In exemplary embodiments, the system 100*a-b* may be principally located, but not limited to, the area defining the central cavity 112. In an exemplary embodiment, the respective apertures of the facing anchor 108 and formation anchor 110 are positioned in the central cavity 112 for connection in the system 100*a-b*. Within the cavity 112, the system 100*a-b* may be detachably coupled to the facing anchors 108 and formation anchors 110 via a turnbuckle 114. After fully assembling the systems 100*a-b*, the cavity 112 may be filled in varying degree of lift thicknesses with soil, concrete, gravel or any other viable fill material. Alternatively, the cavity 112 may be left vacuous in the event that future adjustments to the system 100*a-b* need to be made.

Figure 3:
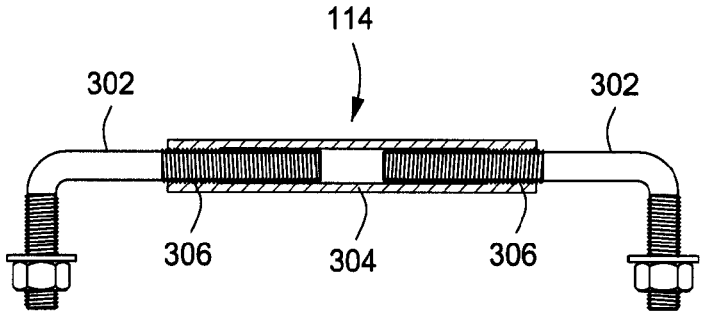
FIG. 3 is a side view of a portion of the system shown in FIG. 1.

Referring to FIG. 3, illustrated is an exemplary embodiment of a turnbuckle 114 that may comprise connectors 302 that may be threadably received into a turnbuckle housing 304. As is the case with any off-the-shelf turnbuckle, the turnbuckle housing 304 may comprise two oppositely threaded boreholes 306. The threaded boreholes 306 are configured to bring the connectors 302 toward and/or away from one another, by twisting or rotating the turnbuckle housing 304. Typically, the threaded boreholes 306 may comprise opposing threads; i.e., one containing right-hand threads and the other containing left-hand threads.

In an exemplary application, the turnbuckle 114 is commercially available and may be purchased at any rigging hardware supply store for the particular application. In an alternative embodiment, the turnbuckle 114 may be assembled on site by welding a pair of threaded nuts at opposing ends of one or more wire struts, and arranging the nuts to be oppositely threaded.

Figure 4A:
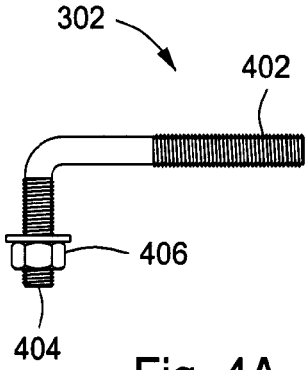
FIGS. 4A-4C are side views of various portions of the system shown in FIG. 1.
Figure 4B:
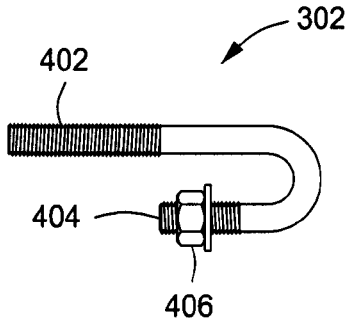
Figure 4C:
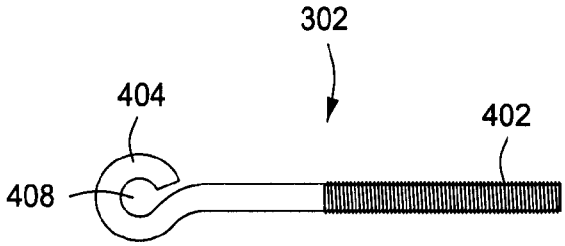

Referring to FIGS. 4A-4C, illustrated are exemplary embodiments of the connector 302. As depicted, the connector 302 may comprise a L-bolt (FIG. 4A), a J-bolt (FIG. 4B) and/or an eye-bolt (FIG. 4C). As may be appreciated, connectors 302 may be used interchangeably on either end of the turnbuckle housing 304 to fit the particular application. The connectors 302 in the exemplary embodiments illustrated in FIGS. 4A and 4B, may comprise a threaded proximal end 402 and a threaded distal end 404, relative to the turnbuckle housing 304. In an exemplary embodiment, the proximal end 402 may be threadably coupled to the turnbuckle housing 304, and the distal end 404 may be coupled to either a facing anchor 108 or a formation anchor 110 and secured against removal by threading on a nut 406.

Figure 8:
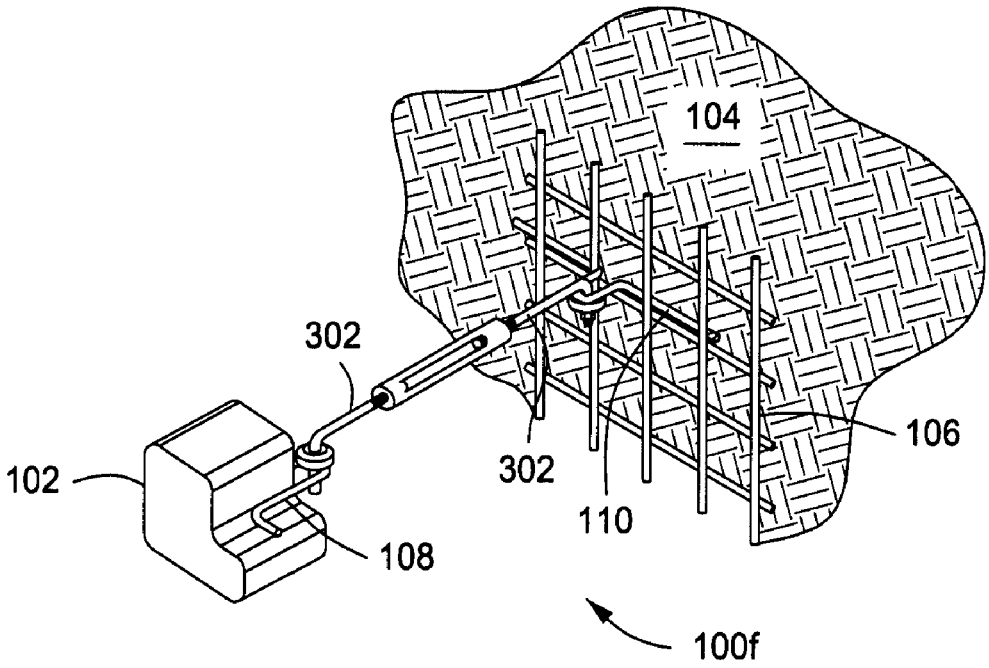
FIG. 8 is a perspective view of a system according to one or more aspects of the present disclosure.
Figure 9:
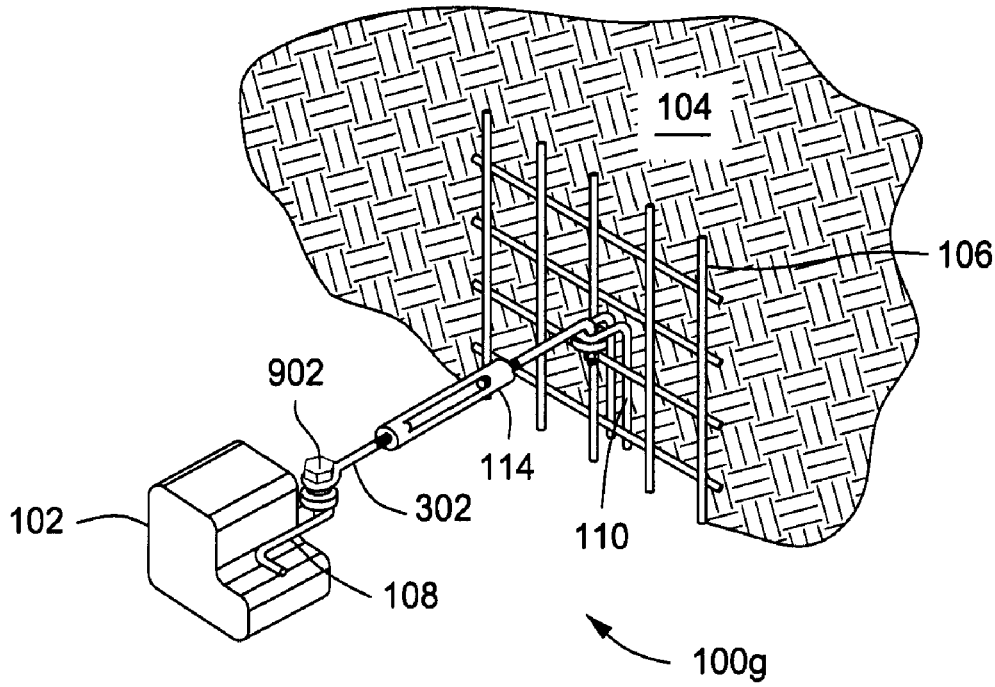
FIG. 9 is a perspective view of a system according to one or more aspects of the present disclosure.

For example, as illustrated in FIG. 8, the distal end 404 may be coupled to a facing anchor 108, and/or, as illustrated in FIGS. 1, 2, and 9, the distal end 404 may be coupled to a formation anchor 110. In the illustrated exemplary applications, the distal end 404 may be inserted into the aperture of a facing anchor 108 or a formation anchor 110 and then secured against removal by threading on a nut 406. In another embodiment, the distal end 404 may be bent over itself to prevent removal, or any other means which serves to prohibit dislodgement.

Illustrated in FIG. 4C is an exemplary embodiment of the eye-bolt connector 302 wherein its distal end 404 relative to the turnbuckle housing 304 may comprise an eyelet 408. The eyelet 408 may be configured to provide sliding engagement between the facing 102 and the wire grids 106 by passing a rod 410 (illustrated in FIGS. 1, 2, and 5-7) through the eyelet 408 as it overlays the aperture of a facing anchor 108 or a formation anchor 110. In an exemplary embodiment, the rod 410 may comprise a smooth steel shaft, but may also comprise a segment of rebar, a bolt (see FIG. 9), a cylindrical plastic shaft, or any shaft capable of withstanding the forces applied in the particular embodiment. The rod 410, not limited in its length, may be configured to pass through any number of facing anchors 108, formation anchors 110, and eyelets 408. In an exemplary embodiment, the rod 410 may be secured against removal by a variety of means, including, but not limited to, bending the end back over itself, welding a bar stop member to the ends of the rod 410, or by threading a washer and nut assembly to each end.

Referring to FIG. 5, illustrated is a perspective view of a system 100*c* according to another aspect of the present disclosure. In an exemplary embodiment, the system 100*c* may be applied to the facing 102 and wire grid 106 via at least two rods 410 and a pair of eye-bolt connectors 302 coupled to the turnbuckle 114. In the illustrated embodiment, the rods 410 are both placed horizontally and coupled to a facing anchor 108 and a formation anchor 110. As can be appreciated in the illustrated embodiment, system 100*c* may be free to move back and forth in the x-direction, and also rotate about the eyelet 408 of the connectors 302 as the earthen formation 104 continues to settle during and after construction. It will be further appreciated that the facing anchors 108 and the formation anchors 110 are not required to be adjacently located, thus allowing for their placement at any location on the facing 102 and wire grids 106, respectively.

Figure 6:
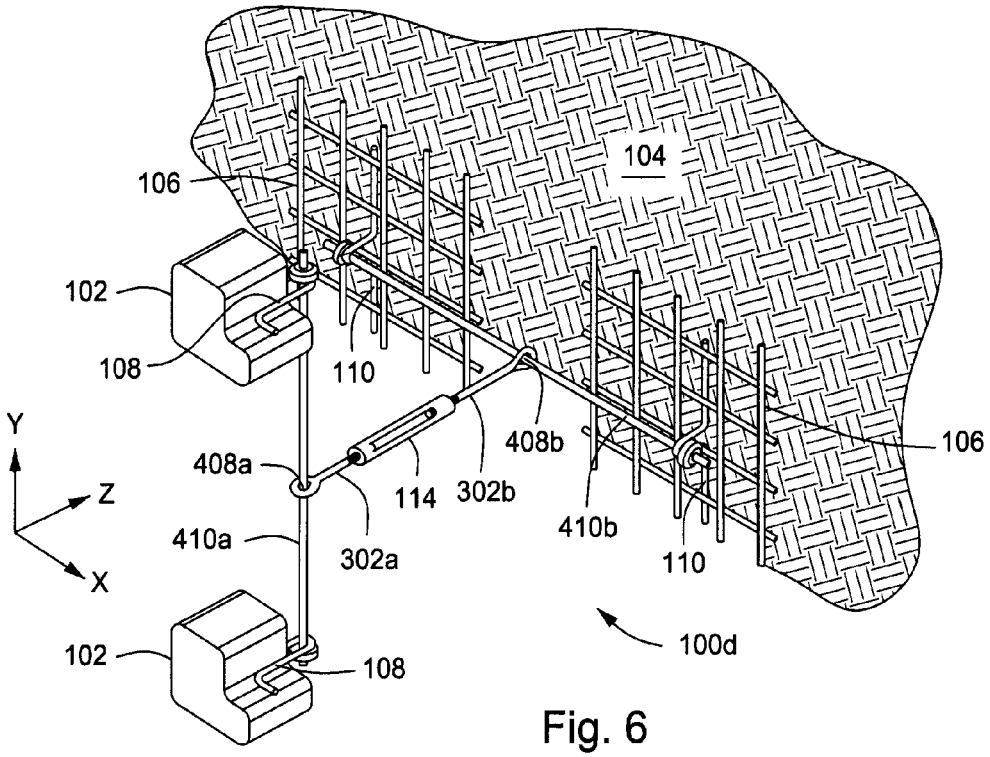
FIG. 6 is a perspective view of a system according to one or more aspects of the present disclosure.

In FIG. 6, illustrated is an exemplary embodiment of a system 100*d* that may be configured to allow motion in both the x-direction and y-direction and also rotation about the eyelets 408 of the connectors 302. As depicted, the system 100*d* may be applied to the facing 102 and wire grids 106 by means of at least two rods 410*a*, 410*b* and a pair of eye-bolt connectors 302*a*, 302*b*. In an exemplary embodiment, one rod 410*a* is coupled vertically between at least two facing anchors 108, thus allowing the eye-bolt connector 302*a* to slide vertically in the y-direction and rotate about its eyelet 408*a*. Another rod 410*b* may be coupled horizontally between at least two formation anchors 110, thus allowing the eye-bolt connector 302*b* to slide horizontally in the x-direction and rotate about its eyelet 408*b*. As can be appreciated in the illustrated embodiments, the facing anchors 108 and the formation anchors 110 are not required to be adjacently aligned, thus allowing for their placement at any location on the facing 102 and wire grids 106, respectively.

Figure 7:
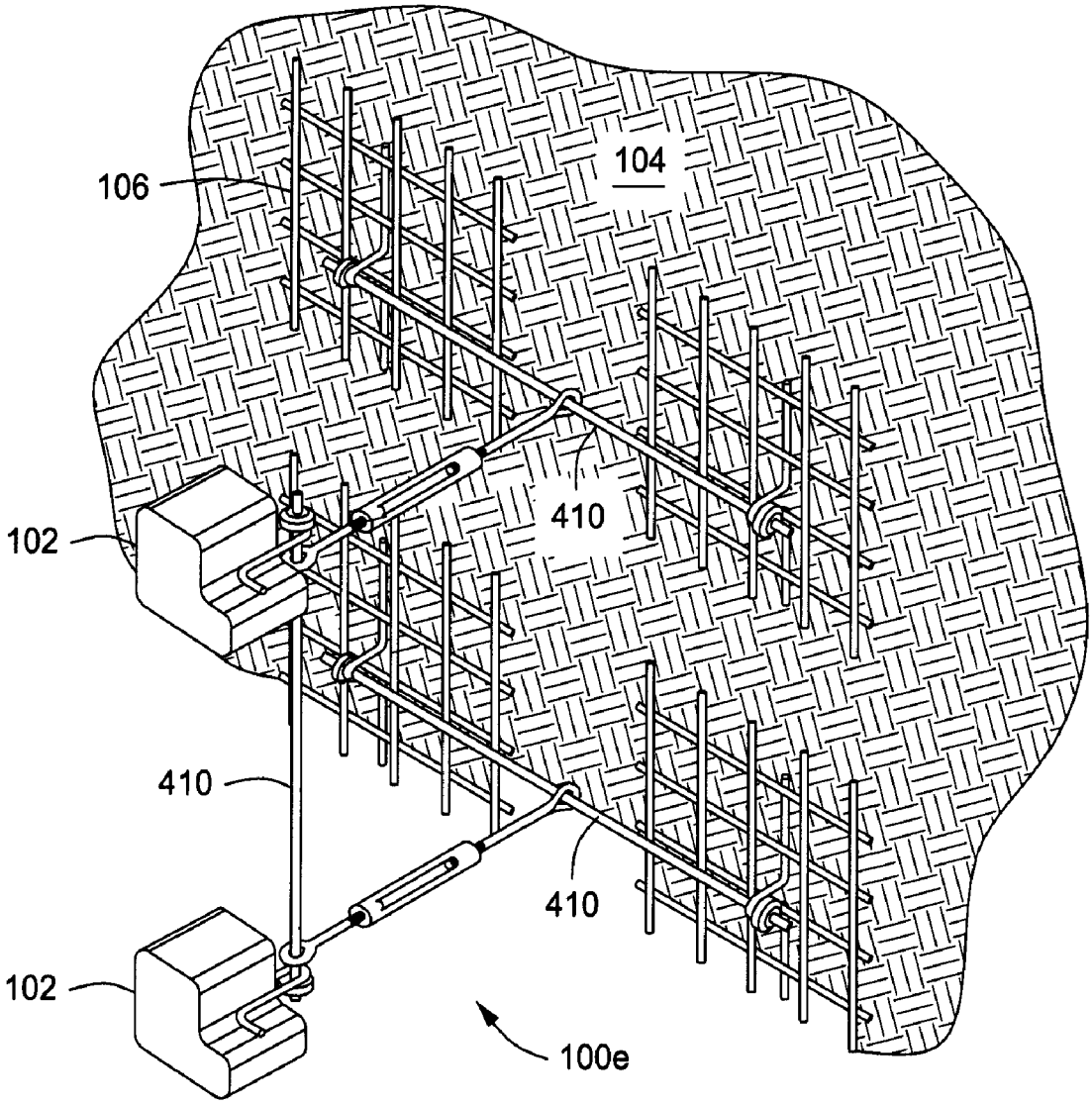
FIG. 7 is a perspective view of a system according to one or more aspects of the present disclosure.

Referring to FIG. 7, shown is another system 100*e* demonstrating that multiple embodiments of the systems 100*a-d* can be used simultaneously and in any number of configurations to allow shifting during the potential settling of the facing 102 and/or the earthen formation 104. As can be seen, the rods 410 may be placed in any configuration to suit the needs of the particular application. For example, the rods 410 do not necessarily have to be placed vertically or horizontally, but may be placed at any angle. Once again, the facing anchors 108 and formation anchors 110 need not be adjacently aligned, but instead may be positioned at any location on the facing 102 and wire grids 106, respectively.

Referring to the exemplary embodiments illustrated FIGS. 8 and 9, the facing anchor 108 and the formation anchor 110 may be positioned either horizontally or vertically to fit the application. They may, furthermore, be interchanged with varying designs that would similarly accomplish the objective; i.e., to secure the facing 102 to the wire grid 106. In FIG. 8, illustrated is an exemplary embodiment of a system 100*f* where the connectors 302 are coupled directly to the facing anchor 108 and the formation anchor 110. In FIG. 9, the eye-bolt connector 302 is directly coupled to the facing anchor 108 via a bolt 902. The bolt 902 may be secured against removal via a threaded nut and/or other means. Moreover, the eye-bolt connector 302 may be coupled to the facing anchor 108 via any shaft that is passed through the defined aperture of the facing anchor 108.

A system for securing a facing has been described. The system may comprise a wire grid that is positionally fixed relative to an earthen formation in a substantially vertical position, a formation anchor that is positionally fixed between the wire grid and the earthen formation, a facing that is laterally offset a distance from the wire grid and having a facing anchor, and a turnbuckle that may be rotatably coupled between a first connector and a second connector. The first connector in the system may be coupled to the facing anchor and the second connector may be coupled to the formation anchor. Rotation of the turnbuckle relative to the first and second connectors may result in adjusting the distance between the wire grid and the facing.

The wire grid of the system may comprise vertical wires and horizontal cross wires that are substantially orthogonal to the vertical wires. The system may also comprise soil reinforcing elements that are embedded within the earthen formation and coupled to the wire grid, but not coupled to a formation anchor. The facing anchor may define an aperture that is configured to receive the first connector, while the formation anchor may define an aperture that is configured to open substantially vertically or substantially horizontally and receive the second connector. The turnbuckle of the system may further comprise two oppositely threaded boreholes each configured to receive a corresponding one of the first and second connectors, wherein each of the first and second connectors may be either a threaded J-bolt or a threaded L-bolt, or in the alternative a threaded eye-bolt. The system may also comprise the facing anchor as a first facing anchor, the formation anchor as a first formation anchor, and further comprising a second facing anchor, a second formation anchor that is positionally fixed between the wire grid and the earthen formation, and a rod that is moveably coupled to the first and second facing anchors or the first and second formation anchors and further coupled to the threaded eye-bolt. The rod may comprise a steel shaft and span substantially horizontally or substantially vertically between the first and second facing anchors or the first and second formation anchors.

A method for securing a facing has also been described. The method may comprise positionally fixing a wire grid relative to an earthen formation in a substantially vertical position, positionally fixing a formation anchor between the wire grid and the earthen formation, positioning a facing laterally offset a distance from the wire grid, wherein the facing comprises a facing anchor, connecting a first connector to the facing anchor, connecting a second connector to the formation anchor, and rotatably coupling a turnbuckle between the first connector and the second connector to adjust the distance. The method may further comprise coupling a soil reinforcing element embedded within the earthen formation to the wire grid, wherein the soil reinforcing element is not coupled to the formation anchor. With the facing anchor as a first facing anchor, the formation anchor as a first formation anchor, the method may further comprise coupling a second facing anchor to the facing, positionally fixing a second formation anchor between the wire grid and the earthen formation, and coupling a rod to the first and second facing anchors or the first and second formation anchors and further coupling the rod to a threaded eye-bolt.

A kit has also been described. The kit may comprise a wire grid configured to be secured to an earthen formation in a substantially vertical position, a formation anchor configured to be positionally fixed between the wire grid and the earthen formation, a facing configured to be laterally offset a distance from the wire grid, a facing anchor configured to be coupled to the facing, a first connector configured to be coupled to the formation anchor, a second connector configured to be coupled to the facing anchor, and a turnbuckle configured to be rotatably coupled to the first and second connectors, wherein rotation of the turnbuckle relative to the first and second connectors adjusts the distance. The kit may further comprise a soil reinforcing element configured to be embedded within the earthen formation, wherein the soil reinforcing element is configured to secure the wire grid to the earthen formation but not configured to secure the formation anchor relative to the wire grid or the earthen formation thereby allowing the formation anchor to be positionally fixed in any location on the wire grid. The kit may also comprise a first rod and a second rod configured to slidingly engage the first connector and the second connector, respectively, wherein the first rod is further configured to be slidingly coupled to at least two formation anchors, and the second rod is further configured to be slidingly coupled to at least two facing anchors.

The foregoing disclosure and description of the disclosure is illustrative and explanatory thereof. Various changes in the details of the illustrated construction may be made within the scope of the appended claims without departing from the spirit of the disclosure. While the preceding description shows and describes one or more embodiments, it will be understood by those skilled in the art that various changes in form and detail may be made therein without departing from the spirit and scope of the present disclosure. For example, various steps of the described methods may be executed repetitively, combined, further divided, replaced with alternate steps, or removed entirely. In addition, different shapes and sizes of elements may be combined in different configurations to achieve the desired earth retaining structures. Therefore, the claims should be interpreted in a broad manner, consistent with the present disclosure.

We claim:

1. A system for securing a facing, comprising:

a wire grid positionally fixed relative to an earthen formation in a substantially vertical position;

a formation anchor positionally fixed between the wire grid and the earthen formation;

a soil reinforcing element embedded within the earthen formation and coupled to the wire grid but not coupled to the formation anchor;

a facing laterally offset a distance from the wire grid and having a facing anchor coupled thereto; and a turnbuckle housing having threaded boreholes at first and second ends of the turnbuckle housing, wherein a first connector is threadably coupled to the first end of the turnbuckle housing and coupled to the facing anchor, and a second connector is threadably coupled to the second end of the turnbuckle housing and coupled to the formation anchor, such that rotation of the turnbuckle housing relative to the first and second connectors adjusts the distance.

2. The system of claim 1 wherein the wire grid comprises vertical wires and horizontal cross wires substantially orthogonal to the vertical wires.

3. The system of claim 1 wherein the facing anchor defines an aperture configured to receive the first connector.

4. The system of claim 1 wherein the formation anchor defines an aperture configured to open substantially vertically or substantially horizontally and receive the second connector.

5. The system of claim 1 wherein each of the first and second connectors is either a threaded J-bolt or a threaded L-bolt.

6. The system of claim 1 wherein one of the first and second connectors comprises a threaded eye-bolt.

7. The system of claim 6 wherein the facing anchor is a first facing anchor, the formation anchor is a first formation anchor, and the system further comprises:

a second facing anchor;

a second formation anchor positionally fixed between the wire grid and the earthen formation; and a rod moveably coupled to the first and second facing anchors or the first and second formation anchors and further coupled to the threaded eye-bolt.

8. The system of claim 7 wherein the rod comprises a steel shaft.

9. The system of claim 7 wherein the rod spans substantially horizontally or substantially vertically between the first and second facing anchors or the first and second formation anchors.

10. The system of claim 1 wherein the facing comprises a plurality of precast concrete panels stacked one atop the other.

11. The system of claim 1 wherein the facing comprises a cast-on-site continuous concrete wall.

12. A method for securing a facing, comprising:

positionally fixing a wire grid relative to an earthen formation in a substantially vertical position;

positionally fixing a formation anchor between the wire grid and the earthen formation;

coupling a soil reinforcing element to the wire grid but not to the formation anchor, wherein the soil reinforcing element is embedded within the earthen formation;

positioning a facing laterally offset a distance from the wire grid, wherein the facing comprises a facing anchor;

connecting a first connector to the facing anchor;

connecting a second connector to the formation anchor;

coupling a turnbuckle housing to the first and second connectors, the turnbuckle housing having threaded boreholes at first and second ends of the turnbuckle housing, wherein the first connector is threadably coupled to the first end of the turnbuckle housing and the second connector is threadably coupled to the second end of the turnbuckle housing; and rotating the turnbuckle housing to adjust the distance.

13. The method of claim 12 wherein the facing anchor is a first facing anchor, the formation anchor is a first formation anchor, and the method further comprises:

coupling a second facing anchor to the facing;

positionally fixing a second formation anchor between the wire grid and the earthen formation; and coupling a rod to the first and second facing anchors or the first and second formation anchors and further coupling the rod to a threaded eye-bolt.

14. A kit, comprising:

a wire grid configured to be secured to an earthen formation in a substantially vertical position;

a formation anchor configured to be positionally fixed between the wire grid and the earthen formation;

a soil reinforcing element configured to be embedded within the earthen formation and coupled to the wire grid but not coupled to the formation anchor;

a facing configured to be laterally offset a distance from the wire grid;

a facing anchor configured to be coupled to the facing;

a first connector configured to be coupled to the formation anchor;

a second connector configured to be coupled to the facing anchor; and a turnbuckle housing having threaded boreholes at first and second ends of the turnbuckle housing, the first connector being threadably coupled to the first end of the turnbuckle housing, and the second connector being threadably coupled to the second end of the turnbuckle housing, wherein rotation of the turnbuckle housing relative to the first and second connectors adjusts the distance.

15. The kit of claim 14 wherein the soil reinforcing element is configured to secure the wire grid to the earthen formation.

16. The kit of claim 14 wherein the formation anchor is configured to be positionally fixed in any location on the wire grid.

17. The kit of claim 14 further comprising a first rod and a second rod configured to slidingly engage the first connector and the second connector, respectively.

18. The kit of claim 17 wherein the first rod is further configured to be slidingly coupled to at least two formation anchors, and the second rod is further configured to be slidingly coupled to at least two facing anchors.

* * * * *